United States Patent [19]

Loftus

[11] 4,134,325

[45] Jan. 16, 1979

[54] DRUM AND PEDAL BEATER ASSEMBLY

[76] Inventor: Michael E. Loftus, 8271 Huron, Taylor, Mich. 48180

[21] Appl. No.: 902,727

[22] Filed: May 3, 1978

Related U.S. Application Data

[63] Continuation of Ser. No. 718,379, Aug. 27, 1976, abandoned.

[51] Int. Cl.[2] ..... G10D 13/00

[52] U.S. Cl. ..... 84/422 R

[58] Field of Search ..... 84/422 R

[56] References Cited

U.S. PATENT DOCUMENTS

| | | | |
|---|---|---|---|
| 2,027,869 | 1/1936 | La Londe | 84/422 R |
| 3,030,847 | 4/1962 | Thompson | 84/422 R |
| 3,930,431 | 1/1976 | Magadini | 84/422 R |
| 3,988,957 | 11/1976 | Escamilla | 84/422 R |

*Primary Examiner*—Lawrence R. Franklin

*Attorney, Agent, or Firm*—Charles W. Chandler

[57] ABSTRACT

A drum and pedal beater assembly in which a pair of beaters are connected to a pair of side-by-side pedals such that the performer can engage one pedal with his toe and the other pedal with his heel to independently operate the two beaters against a common drum skin. One pedal beater assembly has an adjustable length to accommodate the foot of the user. A pair of vertically adjustable rim clamps, each of which are rotatable through 360°, provide universal connectors to secure the adjustable drum beater to the drum rim in any desired location.

1 Claim, 3 Drawing Figures

DRUM AND PEDAL BEATER ASSEMBLY

This is a continuation of application Ser. No. 718,379, filed Aug. 27, 1976, now abandoned.

BACKGROUND OF THE INVENTION

This invention is related to drum and pedal beater assemblies and more particularly to a pair of pedals that are so adjustable that the performer can independently move one beater with his heel and the other beater with his toe against a common drum skin.

The prior art discloses drum and beater assemblies in which a pair of beaters are so mounted adjacent either one or a pair of drums as to be operated by a single foot of the performer. For example, such multiple drum beater assemblies are disclosed in U.S. Pat. No. 3,677,128 which issued to Allan R. Simpson and U.S. Pat. No. 2,484,302 which issued to S. N. Laverents. Such prior art pedal assemblies are limited for practical use because they do not accomodate feet of different lengths and can be connected only to the bottom of the drum rim.

SUMMARY OF THE INVENTION

The broad purpose of the present invention is to provide a drum and pedal beater assembly employing a pair of beaters each connected to its own pedal. The two pedals are mounted side by side and so connected to the drum rim that the distance between the two drum pedals, as well as the length of one pedal, can be adjusted to accomodate the foot length of the user.

These and still other objects of the invention will become readily apparent to those skilled in the art to which the invention pertains upon reference to the following detailed description.

DESCRIPTION OF THE DRAWING

The description refers to the accompanying drawing in which like reference characters refer to like parts throughout the several views, and in which.

DESCRIPTION OF THE PREFERRED EMBODIMENT

Figure 1:
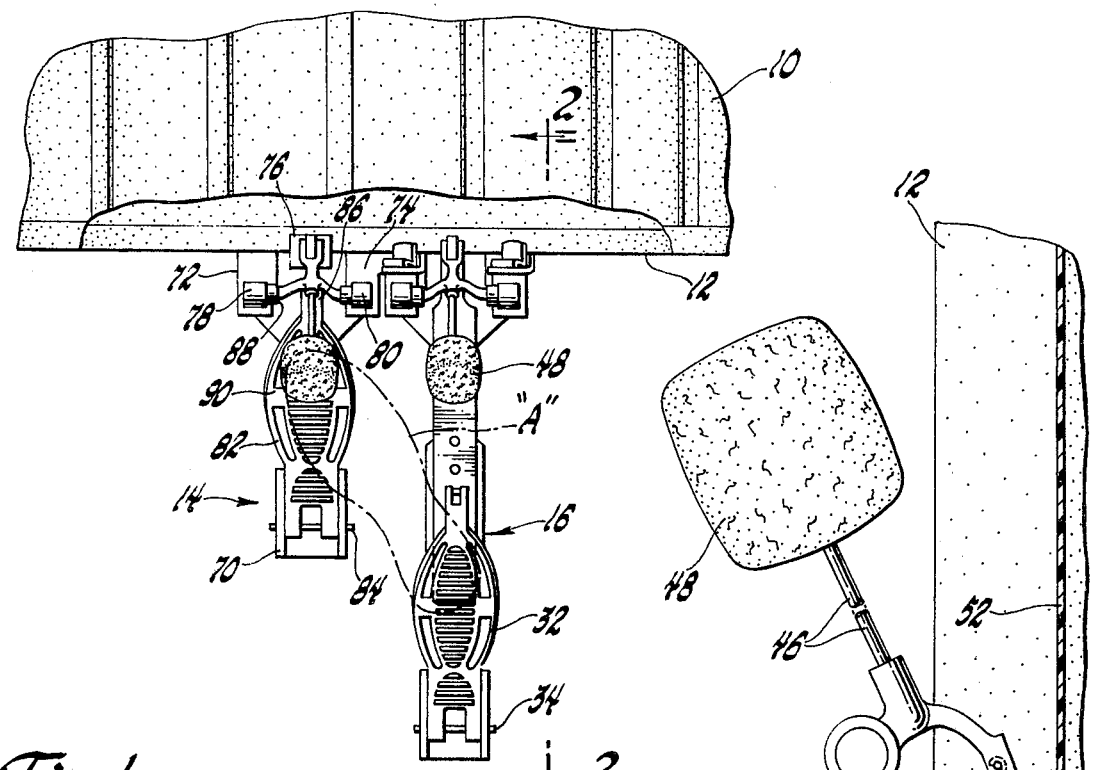
FIG. 1 illustrates a view of a drum and pedal beater assembly illustrating the preferred embodiment of the invention.

Now referring to the drawing, FIG. 1 illustrates a conventional drum 10 having a circular rim 12. The drum is normally mounted in a playing position in which the rim is disposed in a vertical position. A pair of pedal assemblies 14 and 16 are connected to rim 12 of the drum in a side-by-side relationship such that the user can place a foot illustrated in phantom at "A" in a position in which his toe is disposed to operate pedal assembly 14 and his heel is disposed to operate pedal assembly 16.

Figure 2:
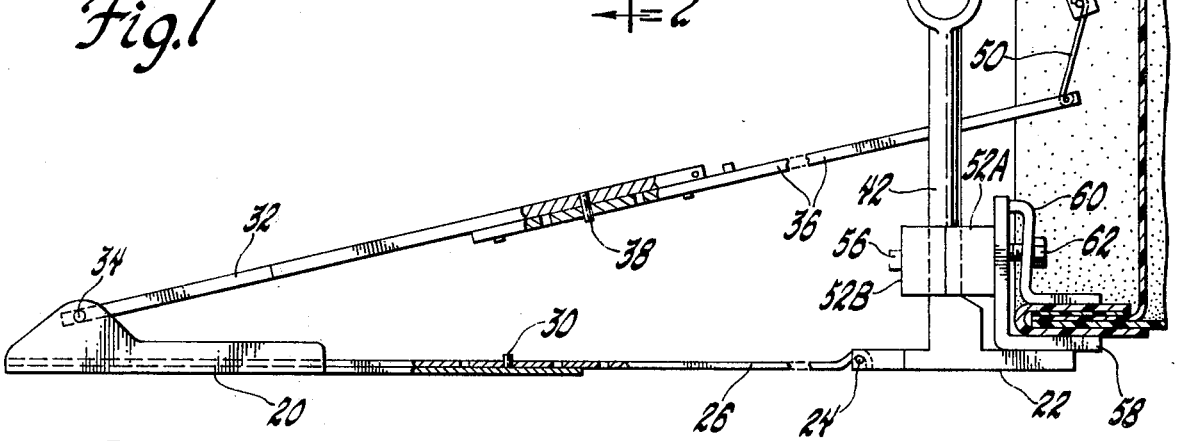
FIG. 2 is a side view of the adjustable pedal assembly.

Referring to FIG. 2, pedal assembly 16 comprises a pair of spaced base members 20 and 22. A pin 24 is carried by base member 22. An elongated base element 26 has one end curled around pin 24 and a series of longitudinally spaced openings 28 adjacent its opposite end. Fastener means 30 carried by base member 20 connects a selected opening 28 to base member 20 so that the performer can adjust the distance between base member 20 and base member 22.

A heel member 32 is pivotally connected by pin 34 to base member 20.

An elongated toe member 36 is connected by fastener 38 to heel member 32. Toe member 36 also has a plurality of holes 40 which permit the performer to adjust the overall length of the foot pedal.

A pair of parallel upright supports 42 and 44 are mounted on opposite sides of base member 22. A beater 46 having a head 48 is pivotally supported between supports 42 and 44. A link 50 connects beater 46 to the end of toe member 36 in such a manner that by lowering toe assembly 36, beater head 48 is moved toward skin 52 of the drum in a manner well known to those skilled in the art.

Figure 3:
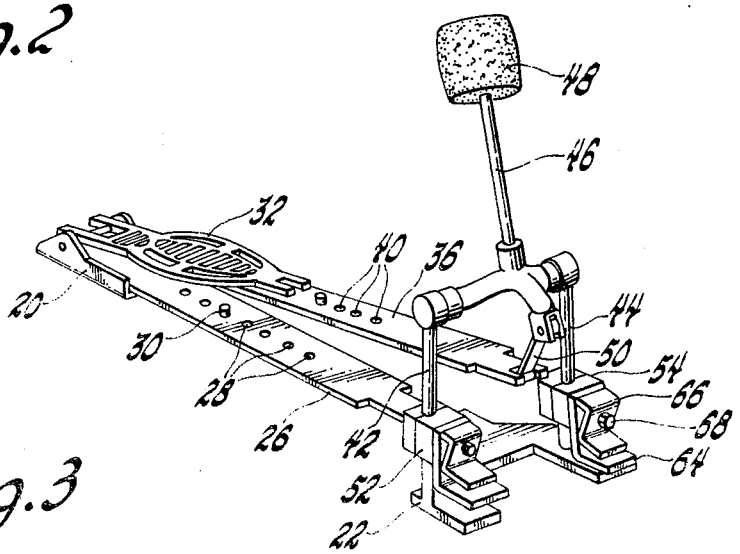
FIG. 3 is a perspective view of the adjustable pedal assembly

Referring to FIGS. 2 and 3, a pair of blocks 52 and 54 are mounted on supports 42 and 44, respectively. Each block is vertically slidably mounted on its respective support and, as illustrated in FIG. 2, is composed of a pair of halves 52A and 52B connected together by fastener means 56. Block 54 is also formed of a pair of halves joined together by a fastener for clamping the two blocks together in a selected vertical position. An L-shaped clamp 58 is attached to block 52. L-shaped clamp 58 is formed to engage the bottom of rim 12. A second clamping member 60 is connected to clamp 58 by fastener 62 in such a manner that by manipulating the fastener with clamping members 58 and 60 on opposite sides of rim 12, base member 22 can be rigidly attached to the drum rim. Clamp 58 and clamping member 60 are each pivotal in an arc of 360° so as to be able to accomodate the slant of the base drum rim.

A pair of clamping members 64 and 66 are connected together by fastener 68 to block 54. Clamping members 64 and 66 are formed to engage opposite sides of drum rim 12 so that by manipulating fastener 68, the two pairs of clamping members can cooperate in connecting pedal assembly 16 to the drum.

Pedal beater assembly 14 is a conventional pedal beater of the type well known to those skilled in the art and comprises a base 70 having a pair of feet 72 and 74 disposed beneath rim 12 of the drum. A clamping foot 76 is mounted on base 70 engaging the opposite side of rim 12 so that it is clamped between feet 72 and 74 and clamping foot 76. A pair of upright supports 78 and 80 are mounted on opposite sides of base 70 adjacent the drum rim. A pedal 82 has its rearward end pivotally connected by pin 84 to base 70. The opposite end of pedal 82 is connected by a flexible strap 86 which is connected to pivotal means 88 mounted between supports 78 and 80. A beater head 90 is mounted on means 88 so that as the foot pedal is depressed the beater head is moved toward the drum skin. A spring means enclosed in support 78 and 80, in a manner well known to those skilled in the art, urges the beater head toward its rearward position and the pedal 82 towards its raised position.

In use, it can be seen that drum rim 12 will be clamped to the forward end of the two pedal assemblies. The adjustable clamping members associated with pedal assembly 16 permit this assembly to be adjusted with respect to pedal assembly 14. Also by adjusting the overall length of pedal assembly 16 to accomodate his heel, the performer can adjust the position of the two pedal assemblies to accomodate the length of his foot. By appropriately arranging the two pedal assemblies, the user can then readily operate the two beaters to produce a desirable rhythm on the drum.

Having described my invention, I claim:

1. A drum and pedal assembly, comprising:

a drum having a circular rim;

first base means;

a first beater mounted on the first base means for engaging the drum in a beating motion;

second base means;

a second beater mounted on the second base means for engaging the drum in a beating motion, independent of the motion of the first beater;

a first pedal, and means connecting the first pedal to the first base means for pivotal motion, the first pedal being connected to the first beater for moving it in its beating motion;

a second pedal, and means connecting the second pedal to the second base means for pivotal motion, the second pedal being connected to the second beater for moving it in its beating motion, the second pedal being adjustably mounted on the second base means such that the distance between the second pedal and the drum is greater than the distance between the first pedal and the drum;

a pair of elongated vertical, horizontally spaced supports mounted on one of said base means;

a pair of vertically adjustable independently movable clamping means mounted on said vertical supports, each of said clamping means being connected to the drum rim;

means connecting the other of said base means to the drum rim;

Whereby the user can dispose the toe of his foot on the first pedal and the heel of his foot in either a position spaced from the second pedal, or in a position on the second pedal to move the first beater and the second beater with the same foot.

* * * * *